US008791409B2

(12) United States Patent
Makarov et al.

(10) Patent No.: US 8,791,409 B2
(45) Date of Patent: Jul. 29, 2014

(54) METHOD AND ANALYSER FOR ANALYSING IONS HAVING A HIGH MASS-TO-CHARGE RATIO

(75) Inventors: Alexander Alekseevich Makarov, Bremen (DE); Eduard V. Denisov, Bremen (DE); Nicolaie Eugen Damoc, Stuhr (DE)

(73) Assignee: Thermo Fisher Scientific (Bremen) GmbH, Dremen (DE)

( * ) Notice: Subject to any disclaimer, the term of this patent is extended or adjusted under 35 U.S.C. 154(b) by 0 days.

(21) Appl. No.: 13/560,303

(22) Filed: Jul. 27, 2012

(65) Prior Publication Data

US 2014/0027629 A1 Jan. 30, 2014

(51) Int. Cl.

| | |
|---|---|
| ***H01J 49/04*** | (2006.01) |
| ***H01J 49/40*** | (2006.01) |
| ***H01J 49/00*** | (2006.01) |
| *H01J 49/02* | (2006.01) |

(52) U.S. Cl.

CPC ..... *H01J 49/005* (2013.01); *H01J 49/406* (2013.01); *H01J 49/027* (2013.01)

USPC ..... 250/283; 250/282

(58) Field of Classification Search

CPC ..... H01J 49/04; H01J 49/004; H01J 49/0045; H01J 49/005; H01J 49/027; H01J 49/40; H01J 49/406; H01J 49/408

USPC ..... 250/281–283, 290, 291

See application file for complete search history.

(56) References Cited

U.S. PATENT DOCUMENTS

| | | | | |
|---|---|---|---|---|
| 5,734,161 | A * | 3/1998 | Koster | 250/287 |
| 5,880,466 | A | 3/1999 | Benner | |
| 2007/0278397 | A1* | 12/2007 | Bateman et al. | 250/286 |
| 2008/0149824 | A1* | 6/2008 | Miller et al. | 250/287 |
| 2009/0218486 | A1* | 9/2009 | Whitehouse et al. | 250/288 |
| 2010/0314538 | A1* | 12/2010 | Makarov et al. | 250/283 |
| 2011/0127418 | A1* | 6/2011 | Thomson | 250/282 |
| 2013/0103337 | A1* | 4/2013 | Eiler | 702/86 |

OTHER PUBLICATIONS

Doussineau, et al. "Infrared Multiphoton Dissociation Tandem Charge Detection-Mass Spectrometry of Single Megadalton Electrosprayed Ions", Review of Scientific Instruments 82, 084104 (2011).*

Chernushevich et al, "Collisional Cooling of Large Ions in Electrospray Mass Spectrometry", Anal. Chem. 2004, 76, 1754-1760.*

(Continued)

*Primary Examiner* — Jack Berman
*Assistant Examiner* — David E Smith
(74) *Attorney, Agent, or Firm* — Charles B. Katz

(57) ABSTRACT

A method for mass analyzing multiply-charged ions is provided as well as a mass analyzer suitable for performing the method, the method comprising: introducing multiply-charged ions into an electrostatic mass analyzer where ions undergo multiple changes of direction of motion; detecting the ions in the analyzer; and determining the mass-to-charge ratio of at least some of the detected ions; wherein the absolute velocity in the analyzer of at least some of the ions whose mass-to-charge ratio is determined is not greater than 8,000 m/s and the average path length over the duration of detection of such ions is longer than required for detecting such ions with a mass-to-charge ratio resolving power of 1,000. High resolution mass spectra of high m/z protein complexes, for example in a native state and with low charge, can be achieved.

43 Claims, 5 Drawing Sheets

(56) References Cited

OTHER PUBLICATIONS

Doussineau et al, "Infrared Multiphoton Dissociation Tandem Charge Detection Mass Spectrometry of Single Megadalton Electrosprayed Ions", Review of Scientific Instruments 82, 084104 (2011).*

Chernushevich et al, "Collisional Cooling of Large Ions in Electrospray Mass Spectrometry", Anal. Chem. 76, 1754-1760, 2004.*

Chernushevich et al., "Collisional Cooling of Large Ions in Electrospray Mass Spectrometry," Anal Chem 2004, 76, 1754-1760.

Doussineau et al., "Infrared multiphoton dissociation tandem charge detection-mass spectrometry of single megadalton electrosprayed ions,"Review of Scientific Instruments 82, 084104 (2011).

Heck, "Native mass spectrometry: a bridge between interactomics and structural biology," Nature Methods 2008, 5 (11), 927-933.

Makarov et al., "Dynamics of ions of intact proteins in the Orbitrap mass analyzer," J Am Soc Mass Spectrom 2009, 20, 1486-1495.

* cited by examiner

METHOD AND ANALYSER FOR ANALYSING IONS HAVING A HIGH MASS-TO-CHARGE RATIO

FIELD OF THE INVENTION

The present invention relates to the field of mass spectrometry. Aspects of the invention relate to a method and analyser for mass analysing ions in an electrostatic mass analyser, preferably ions having a high mass-to-charge ratio. Examples of such ions include proteins and protein complexes and other macromolecular species. The invention is particularly, but not exclusively, useful for mass analysing intact proteins and protein assemblies and complexes in a so-called native state, i.e. at near-physiological conditions.

BACKGROUND OF THE INVENTION

Mass spectrometers are widely used to analyse ions on the basis of their mass-to-charge ratio (m/z). Mass spectrometry has become a primary technique for analysis of proteins. The development of electrospray ionization coupled to mass spectrometry has enabled the analysis of large intact proteins and protein complexes, even when the latter are held together by weak non-covalent interactions. A new field has thus emerged, termed native protein mass spectrometry, which focuses on analysis of such species at near-physiological conditions (i.e. at approximately neutral pH). Applications of this approach range from the detailed study of equilibria between different quaternary structures as influenced by environmental changes or binding of substrates or cofactors, to the analysis of intact nano-machineries, such as whole virus particles, proteasomes and ribosomes [A. Heck. Native mass spectrometry: a bridge between interactomics and structural biology, *Nature Methods* 5 (2008) 927-933].

Typically, ions produced at such conditions have a lower charge state and hence high m/z (normally exceeding m/z 5,000-10,000). This brings them outside of the typical mass range of most mass spectrometers and hence it has become a typical application for time-of-flight (TOF) mass analysers due to their ability to access very high m/z, frequently coupled with dedicated quadrupole mass filters (operating at very low frequencies to extend the mass range). However, due to problems with ion detection as secondary electron multiplication becomes ineffective at such m/z for typical ion energies, additional post-acceleration has had to be introduced. The use of TOF mass analysers, however, has drawbacks since the low duty cycle and transmission of typically used orthogonal-acceleration time-of-flight instruments limit sensitivity of detection while limited flight path and post-acceleration limit resolving power to less than one thousand. In order to improve analysis performance for large ions it has been proposed to use ion cooling at elevated pressures after the atmosphere-to-vacuum interface in Q-TOF instruments as described in I. V. Chernushevich, B. A. Thomson, "Collisional Cooling of Large Ions in Electrospray Mass Spectrometry", *Anal. Chem.* 2004, 76, 1754-1760.

In view of the above background, the present invention has been made.

SUMMARY OF THE INVENTION

According to an aspect of the present invention there is provided a method for mass analysing multiply-charged ions comprising: introducing multiply-charged ions into an electrostatic mass analyser where ions undergo multiple changes of direction of motion; detecting the ions in the analyser; and determining the mass-to-charge ratio of at least some of the detected ions; wherein the absolute velocity in the analyser of at least some of the ions whose mass-to-charge ratio is determined is not greater than 8,000 m/s and the average path length over the duration of detection of such ions is longer than required for detecting such ions with a mass-to-charge ratio resolving power of 1,000.

According to another aspect of the present invention there is provided an electrostatic mass analyser for receiving ions therein, the electrostatic mass analyser comprising a detection system for detecting the ions in the electrostatic mass analyser, preferably by image current detection; a signal processing system for determining the mass-to-charge ratio of at least some detected ions; and a control system configured to control the introduction of ions into the electrostatic mass analyser such that the absolute velocity in the electrostatic mass analyser of at least some of the ions whose mass-to-charge ratio is determined is not greater than 8,000 m/s and configured to control the average path length over the duration of detection of such ions so that it is longer than required for detecting such ions with a mass-to-charge ratio resolving power of 1,000.

In a particular aspect, the present invention has been made in order to increase sensitivity and selectivity of detection of heavy proteins in mass analysers. The invention has been made using electrostatic mass analysers, especially electrostatic traps.

The invention surprisingly enables large, multiply-charged ions to be detected with sufficient signal-to-noise ratio to enable their mass-to-charge ratio to be determined, including large ions that were previously beyond mass analysis with analysers other than TOF analysers. Single ion detection is achievable for such large ions. Sensitivity of analysis can be improved by operating a suitable electrostatic mass analyser with energies lower than a threshold for ion fragmentation for example. Selectivity of analysis can be improved by mass or energy filtering of heavy ions prior to analysis in the electrostatic mass analyser for example. The invention thus utilises an approach wherein high-m/z ions, such as protein complexes, are analysed using an electrostatic mass analyser, such as an electrostatic trap (EST), and corresponding instrument improvements are provided. Mass spectrometry of large intact proteins analysed in an electrostatic trap may thereby be performed.

Such ions may include non-covalent complexes of proteins, for example, even in a so-called native state. Such ions typically have a lower charge than proteins prepared from conventional sources and hence even higher m/z. In particular, if the velocity of such ions is low enough, their stability is surprisingly good in electrostatic mass analysers, especially electrostatic traps, such as an Orbitrap™ mass analyser. Moreover, large path lengths of ion motion within the mass analyser during detection can be utilised to provide a high resolving power. In this way, determination of their mass-to-charge ratio can be achieved with higher resolving power than TOF, or other techniques, has achieved for such high m/z ions with good sensitivity. Preferred features of the invention include filtering the ion population introduced into the mass analyser whereby sufficiently intense signals from ions of interest can be obtained and long flight path lengths can be achieved to reach the desired resolving power, such resolving power typically being 1000 or more.

The average path length referred to herein is the average distance travelled by an ensemble of ions in the duration that they are detected, i.e. some detected ions will travel a shorter distance before loss through collision, scattering etc. and others a longer distance. It has been found that such large ions with low absolute velocity may be made to travel distances in the mass analyser sufficiently long to detect them with a resolving power of 1000 or more. The average path length over the duration of detection of such large ions is longer than required for detecting such ions with a mass-to-charge ratio resolving power of 1,000, preferably 2,000 and more preferably 5,000. Thus, resolving powers in excess of the aforementioned values are achievable, e.g. 5,000 to 10,000, or greater. In mass analysers employing image current detection the transient signal detected from the motion of the ions in the analyser is preferably recorded for a duration of at least 50 ms (milliseconds), more preferably 50 to 500 ms, or longer. With low ion velocities and appropriate ion filtering for example, the recording of long detection transients from high m/z ions as described herein is achievable and leads to high resolving power.

The ions travel such long distances in the electrostatic mass analyser due on a path which comprises multiple changes of direction of motion, thereby achieving such distances in an mass analyser with moderate or small dimensions. The average path length travelled by the ions may exceed 500 m (e.g. 500-1000 m), or may exceed 1000 m. The multiple changes of direction of motion may be due to reflection of the ions in two or more ion mirrors. In cases of two ion mirrors, the ions may undergo multiple changes of direction of motion as they are reflected repeatedly between the two ion mirrors. Such is the case in an Orbitrap mass analyser, wherein ions undergo multiple changes of direction of motion as they are reflected repeatedly between two ion mirrors (each mirror comprising a split half of an outer electrode) whilst they continuously orbit around a central electrode.

Optionally, the ions with such low velocities are produced under such conditions that they have a lower charge state and hence high m/z than is usually the case e.g. in proteomics. According to the present invention, at least some of the ions with such low velocities, whose m/z is determined, have m/z normally exceeding m/z 5,000, optionally exceeding m/z 10,000 and further optionally exceeding m/z 15,000. Ions having m/z up to 20,000 and more preferably m/z up to 30,000 may be provided in the mass analyser with the said absolute velocities and may thereby have their m/z determined by the invention. However, an absolute upper limit on the m/z is not implied by the invention.

In more detail, the method preferably comprises steps of producing ions in an ion source and introducing the ions into the mass analyser. An ion optical system is typically required that can enable transmission of large ions intact from the ion source, where such ions are produced, to the mass analyser. Such an optical system preferably comprises a multipole positioned between the ion source and the mass analyser. Such a multipole can be employed for energy filtering of the ions in certain preferred embodiments. A suitable system preferably comprises an RF multipole. The RF multipole or other optical system is preferably configured or operated to transmit ions up to m/z 10,000, more preferably up to m/z 20,000 and even up to m/z 30,000. Typically, this may comprise applying a maximum available RF voltage to the multipole(s) to transmit ions of the highest available m/z among the ions to be analysed. Such high or maximum voltages should also be applied to all other RF ion optical devices such as RF multipoles, e.g. all other RF ion traps or RF ion guides. The multipole(s) referred to herein may suitably be a quadrupole, a hexapole or an octapole etc.

The method preferably comprises providing one or both of a mass-to-charge ratio filter and an energy filter upstream of the electrostatic mass analyser. Accordingly, the ions are preferably filtered on the basis of their mass-to-charge ratio and/or energy prior to introducing them into the electrostatic mass analyser. The filtering, especially energy filtering, is preferably performed after a stage of incomplete cooling of the ions, e.g. after incomplete cooling within a multipole. Incomplete cooling of ions is acceptable in this stage if, downstream of the filter, further (preferably complete) cooling of the ions is performed prior to mass analysis, e.g. within one of more further multipoles that may be in the form of an ion trap or store, or in the form of a collision cell.

Thus, the invention preferably comprises filtering the ions through one or both of a mass-to-charge ratio filter and an energy filter upstream of the electrostatic mass analyser. The filtering of the ions is preferably through a voltage barrier upstream of the electrostatic mass analyser acting as a low mass-to-charge ratio or low energy filter. The invention more preferably further comprises one or more electrodes for applying thereto a barrier voltage to act as a low mass-to-charge ratio or low energy filter. The said electrode(s) could comprise a diaphragm or lens or an electrostatic sector. The said electrodes may comprise rods of a multipole acting as an ion guide, especially an RF multipole. The multipole for this purpose may be the multipole described above, i.e. for guiding the ions from the ion source to the electrostatic mass analyser. In this way, ions of lower masses, for example, may be removed by the filtering prior to the electrostatic mass analyser. This filtering enables more ions of higher mass to fill the electrostatic mass analyser before space charge effects become relevant.

Preferably, a mass or energy filter, such as one as described, is applied to the ions following their expansion in a gas. Preferably, the expansion in a gas occurs at an atmosphere-to-vacuum interface. Thus, in preferred embodiments, the or each filter is preferably positioned downstream of an atmosphere-to-vacuum interface. Such interfaces may be present as an interface between an ion source (at atmospheric pressure) and a vacuum region. The components such as the (or each) filter, the ion optical system etc. are preferably located in the vacuum system.

The average residual ion energy during filtering is proportional to mass with a coefficient of at least: a) 0.5 V/kTh, b) 0.7 V/kTh, or c) 1 V/kTh. Preferably, the residual energy of the ions (final energy of the ions coming from the ion source) during the filtering, for example the energy as determined by expansion at the atmosphere-to-vacuum interface, is proportional to mass and is in the range 0.5 to 1 V/kTh, or greater (1 Th=1 m/z unit).

Preferably, ions of mass-to-charge ratio less than 3000, or less than 4000, or less than 5,000, are substantially filtered out and thereby prevented from entering the electrostatic mass analyser. Thus, the or each filter is preferably configured to substantially filter out ions having mass-to-charge ratio less than 3000, or less than 4000, or less than 5,000, and thereby prevent such ions from entering the electrostatic trap.

Preferably, the invention further comprises, after passing the ions through one or both of said filters, trapping (i.e. storing) the ions in an ion trap, for example a linear ion trap, prior to introducing the ions into the electrostatic mass analyser, which in turn is preferably an electrostatic trap. The ion trap (i.e. store) is thus downstream of one or both filters and upstream of the electrostatic mass analyser. The ion trap is preferably a multipole ion trap, such as a multipole linear ion trap, especially a curved linear ion trap (C-trap).

Preferably, the invention further comprises, after passing the ions through one or both filters, cooling the ions prior to introducing the ions into the electrostatic mass analyser. Cooling may be performed in the aforementioned ion trap (or store). However, for the purpose of cooling, the invention preferably further comprises a collision cell, especially a high pressure collision dissociation (HCD) cell, downstream of one or both filters and upstream of the electrostatic trap. The HCD may be downstream of the ion trap (or store) where present, e.g. in a dead-end position as described in WO 2006/103412.

Preferably, the absolute velocity during detection of the at least some of the ions in the electrostatic trap whose mass-to-charge ratio is determined is not greater than 6,000 m/s, and more preferably is not greater than 5,000 m/s. The control system is thus preferably configured to control the introduction of ions into the electrostatic trap, whereby the absolute velocity of at least some of the ions in the electrostatic trap during detection whose mass-to-charge ratio is determined is not greater than 6,000 m/s, more preferably is not greater than 5,000 m/s.

Preferably, the at least some ions of restricted velocity whose mass-to-charge ratio is determined have a mass-to-charge ratio of least 5,000, more preferably at least 10,000, even more preferably at least 15,000, and up to 30,000, or more. The mass of at least some ions of restricted velocity whose mass-to-charge ratio is determined may be up to 1 MDa or up to 2 MDa, or greater than 1 or 2 MDa (MDa=MegaDalton).

Preferably, the charge of at least some of the ions whose mass-to-charge ratio is determined (preferably having the mass-to-charge ratio of at least 5,000) is a charge less than 30. Preferably, the at least some of the ions in the electrostatic trap whose mass-to-charge ratio is determined have a charge per kDa of mass less than 0.2.

Preferably, the ions are produced by electrospray, MALDI, laserspray or inlet ionization, i.e. the ion source is preferably one of: an electrospray source, a MALDI source, a laserspray source, and an inlet ionization source. The ions are preferably produced by a method of atmospheric pressure ionisation, such as electrospray ionisation, MALDI etc. The ions thus produced are multiply-charged. The ions produced under atmospheric pressure conditions are preferably expanded in a gas at an atmosphere-to-vacuum interface as described. In this way the ions may acquire energy by expansion in the gas. Such energy may be used to enable an effective energy filtering of the ions Preferably, the ions are produced from solution, especially electrosprayed from solution. The ions are preferably produced by (preferably electrospray) methods that favour production of ions with a low charge per unit mass (z/m). The ions are more preferably produced (especially electrosprayed) from a solution with a pH greater than is typical. Most preferably, the pH is 5 or higher. Especially preferred is to produce the ions from a solution with a pH in the range 6 to 8.5, more preferably in the range 7.0 to 7.6. Thus, the solution in such embodiments is preferably at near-physiological condition (pH~7). Thus, the ion source is preferably an electrospray source interfaced to a solution with a pH in the aforesaid ranges, especially in the range 6 to 8.5.

The ions may be derived from one or more different molecules in one or more samples, e.g. macromolecules selected from one or more of the following types of molecules: proteins, protein complexes, polypeptides, biopolymers, biopharmaceuticals, DNA, fragments of DNA, cDNA, fragments of cDNA, RNA, fragments of RNA, mRNA, fragments of mRNA, tRNA, fragments of tRNA, antibodies, monoclonal antibodies, polyclonal antibodies, enzymes, metabolites, etc. The sample that is ionized may comprise, for example, at least 2, 5, 10, 20, 50, 100, 500, 1000, or 5000 different molecules. Preferably, the ions comprise ions of proteins or protein complexes, more preferably in a native state.

Preferably, detecting the ions in the electrostatic mass analyser is by image current detection that comprises detecting an image current transient signal and the pressure in the electrostatic mass analyser is kept below a level whereby the decay constant of the image current transient signal is at least a) 10 ms, or b) at least 20 ms, or c) at least 40 ms. Typically, the pressure in the electrostatic mass analyser is not greater than 10-8 mbar, preferably not greater than 5×10-9 mbar, more preferably not greater than 2×10-9 mbar and even more preferably not greater than 10-9 mbar. The image current detection system preferably comprises at least one electrode, preferably a pair of electrodes, that detect an image current induced by the motion of the ions within the mass analyser, which is preferably periodic motion within the mass analyser.

Preferably, the method comprises transforming the image current transient signal into a mass spectrum wherein the mass spectrum can be used to resolve peaks originating from covalent and/or non-covalent binding of small molecules to proteins or protein assemblies. A signal processing system, e.g. comprising a computer, is preferably provided for this purpose. Further components of the signal processing system may comprise electronics, such as e.g. an analogue to digital converter (digitiser) and/or a preamplifier, to digitise and amplify the transient signal prior to processing and transforming the signal in the computer.

The control system of the mass analyser preferably comprises a computer that is programmed to control the introduction of ions in the said manner. The signal processing system also preferably comprises a computer that is programmed to determine the mass-to-charge ratio of at least some detected ions. The control system and the signal processing system may comprise the same computer, or different computers. Signal processing of the transient signal into a mass spectrum is routine in the art of mass spectrometry, e.g. using Fourier transformation. Accordingly, computer programs are available for execution on the computer that will perform such transformation.

Whilst the mass analyser in general is not limited to any specific type, and for example may not be limited to electrostatic traps but may be a TOF mass analyser, preferably, the method comprises introducing the multiply-charged ions into an electrostatic mass analyser and trapping the ions therein and more preferably the method comprises detecting the (trapped) ions in the electrostatic mass analyser. The electrostatic mass analyser is thus preferably for receiving and trapping ions therein. The electrostatic mass analyser is preferably for causing the ions, e.g. as trapped therein, to under periodic motion, e.g. to oscillate (which term herein also encompasses motion that is rotational) within the mass analyser. Preferably it is the oscillation of the ions in the electrostatic mass analyser that is detected by image current detection. Herein, the term electrostatic mass analyser means a mass analyser which uses an electrostatic field to provide an ion path within the analyser. The electrostatic mass analyser is preferably an electrostatic trap, i.e. an ion trap which uses an electrostatic field to trap ions therein. An example is in a mass analyser or trap which measures the frequency of oscillation of ions trapped in an electrostatic field wherein the oscillation varies harmonically in one direction. Examples include various Fourier transform (FT) mass analysers, with specific examples being FT-Ion Cyclotron Resonance (FT-ICR) mass analysers and orbital trap mass analysers, e.g. that are sold as the Orbitrap™.

A preferred electrostatic field is a hyper-logarithmic electrostatic field. A preferred example of electrostatic trap is one in which ions oscillate in an electrostatic field, thereby undergoing multiple changes of direction, preferably in a hyper-logarithmic electrostatic field, wherein said oscillation comprises the ions orbiting around a central electrode that is elongated axially whilst undergoing harmonic oscillations axially, said trap measuring the frequency of said axial oscillation. In such traps the ions repeatedly undergo changes of direction in the axial direction. Such analysers are sold as the Orbitrap mass analyser. Design and operation of Orbitrap mass analysers is described, for example, in U.S. Pat. No. 5,886,346 and Olsen, J. V.; Schwartz, J. C.; Griep-Raming, J.; Nielsen, M. L.; Damoc, E.; Denisov, E.; Lange, O.; Remes, P.; Taylor, D.; Splendore, M.; Wouters, E. R.; Senko, M.; Makarov, A.; Mann, M. & Horning, S. A Dual Pressure Linear Ion Trap Orbitrap Instrument with Very High Sequencing Speed Mol Cell Proteomics, 2009, 8, 2759-2769.

The step of causing ions to oscillate in the electrostatic field is a well known and necessary feature of Fourier transform (FT) mass analysers. For example, the use of appropriate ion injection into a suitable hyper-logarithmic electrostatic field, as in an Orbitrap mass analyser, will cause the ions to commence oscillation within the mass analyser (i.e. oscillation upon injection) and oscillation continues in the hyper-logarithmic electrostatic field. In FT ICR mass analysers, the application of a magnetic field and an electric excitation field is employed to cause the ions to oscillate.

The frequency of oscillation of the ions is detected as a time domain signal. The frequency of oscillation of the ions can be transformed into the mass-to-charge ratio of the ions, e.g. using a Fourier transform, especially using a fast Fourier transform (FFT). Thus, from the detection of the ions in the electrostatic trap by image current detection, the mass-to-charge ratio (m/z) of the ions may be determined and/or a mass spectrum of the ions may be determined therefrom. If the charge of the ions is known, as is often possible, then the mass of the ions can be determined. The mass-to-charge ratio of the ions may be expressed in units of Thomson (Th). The mass of the ions may be expressed in units of Dalton (Da). Enhanced methods of Fourier transform, such as described in EP 2372747, may be employed to improve the quality of the final mass spectrum.

DETAILED DESCRIPTION OF EMBODIMENTS OF THE INVENTION

In order to enable a more detailed understanding of the invention, numerous representative embodiments will now be described with reference to the accompanying drawings. The embodiments described are merely examples and are not intended to be limiting on the scope of the invention.

Figure 1:
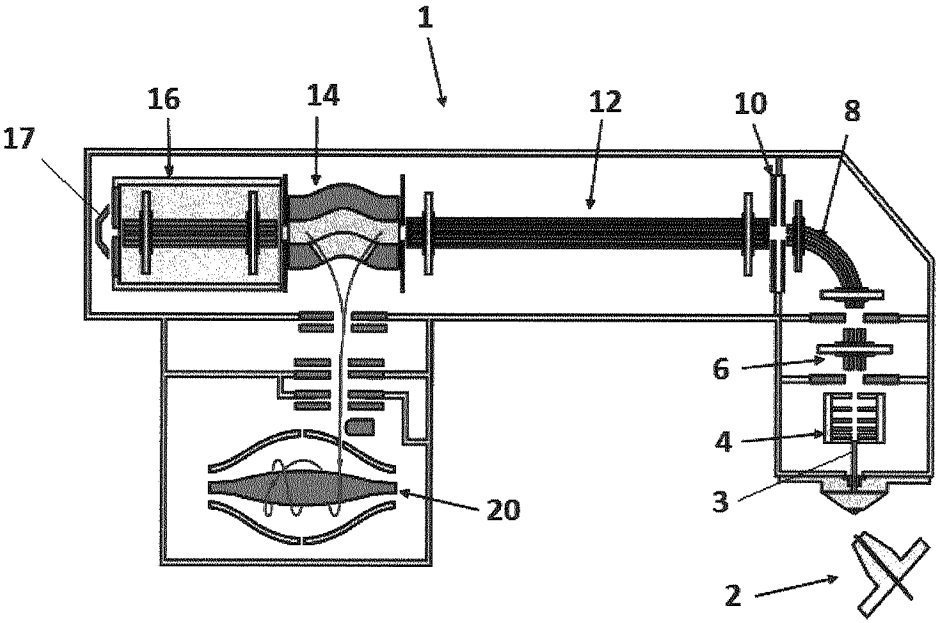
FIG. 1 shows a schematic representation of a preferred embodiment of an electrostatic mass analyser in accordance the present invention.

Referring to FIG. 1, the preferred embodiment is based on an Exactive Plus instrument 1 (Thermo Fisher Scientific, Bremen, Germany) utilising an electrostatic trap in the form of an Orbitrap™ mass analyser. The instrument comprises an electrosprayer 2 at atmospheric pressure. It will be appreciated that other ion sources could be used. For example, the invention could also be used for analysis of ions produced by matrix-assisted laser desorption/ionisation (MALDI), laser-spray or any other inlet ionisation, or indeed any other techniques capable of producing high-m/z ions.

Ions from the electrosprayer pass through a transfer capillary 3 to a stacked ring ion guide (S-lens) 4 and then through an injection flatapole 6 and a bent flatapole 8. The pressure in the region of the S-lens to bent flatapole is typically 1-10 mbar (e.g. 1.6 mbar). The bent flatapole has 2 mm gaps between its rods. A degree of collisional cooling occurs in the bent flatapole. An ion gate 10 in the form of a fast split lens controls the entry of the ions into an RF-only transport multipole 12, which in this embodiment is an octapole and typically held at a pressure less than 10-4 mbar. From the transport multipole the ions enter a C-trap 14 typically with a pressure therein of (0.1-4.0)×10-3 mbar (for example 0.5×10-3 mbar). Optionally the ions may be passed for further cooling into a gas-filled dead-end HCD cell 16 comprising RF multipole rods typically with a pressure of (1-20)×10-3 mbar (e.g. 5×10-3 mbar). From there the ions are passed back into the C-trap. The HCD cell is provided with an axial field for this purpose, e.g. by providing a retarding voltage on the back of the HCD. The HCD cell is separated from the C-trap by a single diaphragm, which allows easy tuning of the HCD cell. If required, the RF and axial field applied to the HCD cell CaO be set to provide for fragmentation of ions therein. The HCD cell allows better trapping while maintaining a certain pressure in the C-trap and thus Orbitrap, because the HCD cell is i) longer and ii) at a higher pressure than the C-trap. Ions are injected from the C-trap into the Orbitrap mass analyser 20. The vacuum in the Orbitrap compartment is preferably below 7×10-10 mbar although it is dependent on the pressure in the HCD cell. For some large proteins, pressures in excess of 2×10-9 mbar could be used. The m/z of larger, slower ions may be determined at such pressures in the Orbitrap, which may be due to the total travelled path that decreases with mass faster than the mean free path increases with mass.

The number of ions in the Orbitrap is controlled automatically (automatic gain control) by measuring the total ion charge using a short pre-scan before the analytical scan and from that calculating the ion injection time for the analytical scan. For high scan rates, the previous analytical scan can be used as the pre-scan to optimize the scan cycle time. Additionally, or alternatively, an ion collector 17 may be placed behind the HCD collision cell and used for independent charge detection, which periodically (e.g. every 5-10 sec) checks and adjusts the accuracy of the automatic gain control. An example of such a system is described in the applicant's patent application number GB 1108473.8 filed 20 May 2011, the contents of which is incorporated herein in its entirety. Transients detected by image current detection in the Orbitrap mass analyser are processed using a Fourier Transformation process on the instrument computer (not shown) to convert the transient signals into frequency components and then m/z. Acquisition speed ranges from 12 Hz for resolving power 17,500 at m/z 200 (corresponding to 3,200 at m/z 6000) to 1.5 Hz for resolving power 140,000 at m/z 200 (corresponding to 25,000 at m/z 6000).

When configured and operated appropriately, the image current transients of very heavy proteins become considerably longer than expected based on existing data on middle-size proteins at the typical operating pressure in the analyser [A. A. Makarov, E. Denisov. "Dynamics of ions of intact proteins in the Orbitrap mass analyzer". J. Am. Soc. Mass Spectrom. 2009, 20, 1486-1495]. It was discovered that this effect occurs once the absolute ion velocity during detection becomes less than approximately 8000 m/s (320 Volts of acceleration voltage per 1000 units of m/z, i.e. V/kTh), and is generally more pronounced below 6000 m/s (acceleration voltage 180 V/kTh). This requirement is directly opposite to what is required for detection in time-of-flight instruments by secondary emission due to detection by image current in the Orbitrap mass analyser. In this way, optimum performance for native MS is enabled. It was found that this condition holds both for nitrogen and xenon collision gases (with masses 28 and 131 Da, respectively). Probably, such independence on collision gas originates from different efficiencies of energy transfer in collisions.

Such reduction of ion energy in the Orbitrap mass analyser even allows it to operate at much higher pressures than usual (e.g. 1-2×10-9 mbar). Similarly, the HCD cell may be operated at a higher pressure than usual of 0.02-0.03 mbar. Even under such conditions, the decay constant of transients from e.g. +66 . . . +75 charge states of GroEl protein complex (mass around 800 kDa) have been found to exceeded 20 ms, thus allowing detection of individual ions with a signal-to-noise ratio of about 4. According to another preferred feature, therefore, the method permits the m/z to be determined from single ions present in the mass analyser. This condition thereby allows significant improvement in sensitivity, mass resolving power and speed of analysis in MS of native and heavy proteins. These improved parameters advantageously allow analysis of covalent and non-covalent binding of small molecules to protein assemblies with good sensitivity and mass resolving power.

As opposed to normal FT/MS conditions, where more charges per molecule are generally regarded as better, it has been found that from a certain mass onwards there is generally enough charges per molecule to detect single ions (depending on the detection times this may be from 5 to 20 charges upwards), and then it becomes of more importance to have multiple species with less charges per ion, giving a better statistical representation of isotope patterns etc. (in other words: more relevant information per time unit).

The inventors have found that selectivity and sensitivity of analysis may be improved by utilising two effects: (i) an incomplete deceleration of heavy ions during collisional cooling, e.g. in the flatapole, that allows them to keep a kinetic energy of about 0.5-1 V/kTh, which roughly corresponds to the velocity of gas expansion in the atmosphere-to-vacuum interface; and (ii) a relatively narrow charge distribution for ions produced in native MS, typically <10% FWHM. In particular as a result of this, the inventors have found that energy filtering can be used to select only m/z range of interest, e.g. with a resolving power 2-3, thus allowing the C-trap, and thereby the Orbitrap mass analyser, to be filled only with ions of interest without the need for a mass filter. In certain embodiments, it will be appreciated that a m/z filter could be employed if need be. In the embodiment of FIG. 1, ion-optical elements can be adjusted to provide low energy and high energy cut-off, e.g. by raising the offset of the transport multipole and reducing the retarding voltage on the back of the HCD multipole respectively. For cutting off high m/z ions, the RF level of one or more of the multipoles could be additionally reduced. In this way, the mass analyser may be filled with more ions of analytical interest, i.e. of high m/z.

The incomplete cooling is acceptable due to subsequent storage and complete cooling of ions in the C-trap and optionally HCD cell. The incomplete cooling, however, enables energy filtering to be advantageously employed after such incomplete cooling stage. This is in contrast to cooling at elevated pressures required after the interface in Q-TOF instruments [I. V. Chernushevich, B. A. Thomson, "Collisional Cooling of Large Ions in Electrospray Mass Spectrometry", Anal. Chem. 2004, 76, 1754-1760].

In the experiments described below, the control software of the instrument was modified to allow the mass range of the instrument to be increased from m/z 50-6,000 to m/z 400-20,000. For example, maximum RF voltages were applied to all RF multipoles in the instrument, including the C-trap. For more efficient desolvation and trapping of large proteins and increased sensitivity, instead of trapping ions in the C-trap directly after leaving the transport multipole, ions were allowed to enter the HCD cell and be stored and cooled there prior to their return back into the C-trap. The HCD cell was equipped with a dedicated gas line that allowed switching between the standard nitrogen collision gas and xenon. The pressure in the Orbitrap compartment reflected variations in HCD cell pressure and it varied between 5×10-10 and 2×10-9 mbar depending on the experiment.

Tuning of the voltage offset on the transport octapole was used for mass/energy filtering of the incoming ions. Retarding voltages up to 5 V were used without affecting the intensity of ions with m/z>6000 whilst almost completely eliminating m/z<3000. Given the relatively low gas pressures in the bent flatapole, this effect is attributed to the velocities acquired by entrained ions during gas-dynamic expansion in the S-lens 4 and the injection flatapole 6 and only partially dissipated by incomplete gas cooling in the bent flatapole 8. Indeed, residual ion velocity needs to exceed about 400 m/s to provide for this effect, which is compatible with terminal air velocity of about 700-800 m/s in the S-lens and the injection flatapole.

Experiments showed that intact macromolecular assemblies, such as protein complexes, up to one MDa can be analysed with single ion sensitivity and high spectral resolution with an Orbitrap mass analyser, which is normally employed for analysis of small molecules such as peptides. The analysis of large intact proteins and complexes in native-like states by mass spectrometry can offer a wealth of information for structural biology and biophysical studies.

Data were acquired and processed using the standard Xcalibur 2.2 software package (Thermo Fisher Scientific, San Jose, Calif.).

For calibration, inorganic salts CsI and ammonium hexafluorophosphate (AHFP) that form clusters of increasing molecular weight were used as mass calibrants. CsI clusters were detected up to m/z 18,000 and AHFP up to m/z 10,000. A resolution of 25,000 at m/z 5,000 and 16,000 at m/z 10,000 could readily be achieved.

Figure 2:
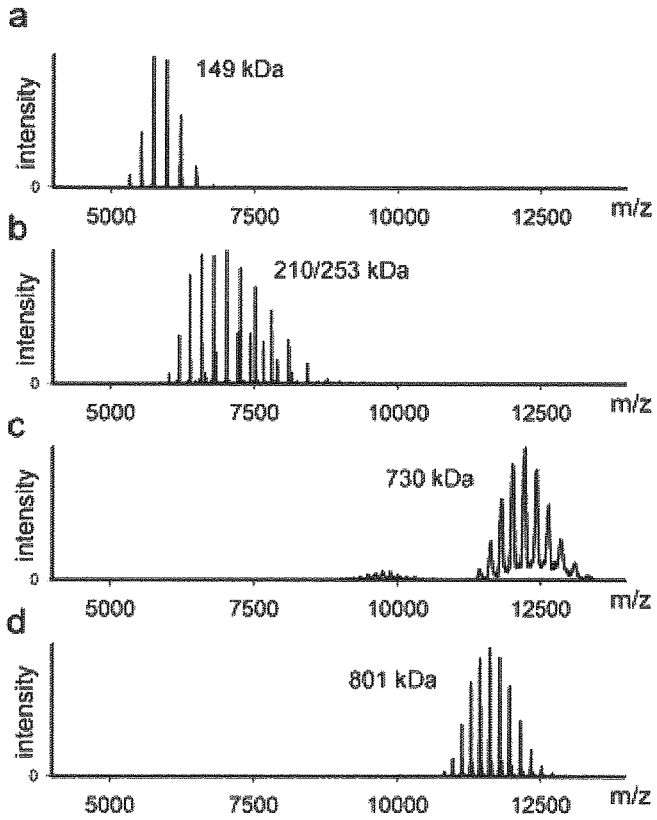
FIG. 2 shows mass spectra of various intact proteins and protein assemblies.

Using the instrument in accordance with the present invention, in a first experiment a monoclonal IgG antibody, consisting of 4 disulphide-linked protein chains, with an approximate molecular weight of 149 kDa was analysed. A narrow charge state distribution at m/z 5,000-7,000 was observed, relating to charges of 24+ to 29+ on the intact antibody as shown in FIG. 2*a*. The molecular weight calculated was within 4 Da of the theoretical value, reflecting a mass accuracy within 30 ppm and indicating complete desolvation. The resolving power of the Orbitrap analyser allowed baseline separation of the various glycosylation forms of the antibody, with molecular weights measured differing by 162 Da, i.e. hexose units.

Figure 3:
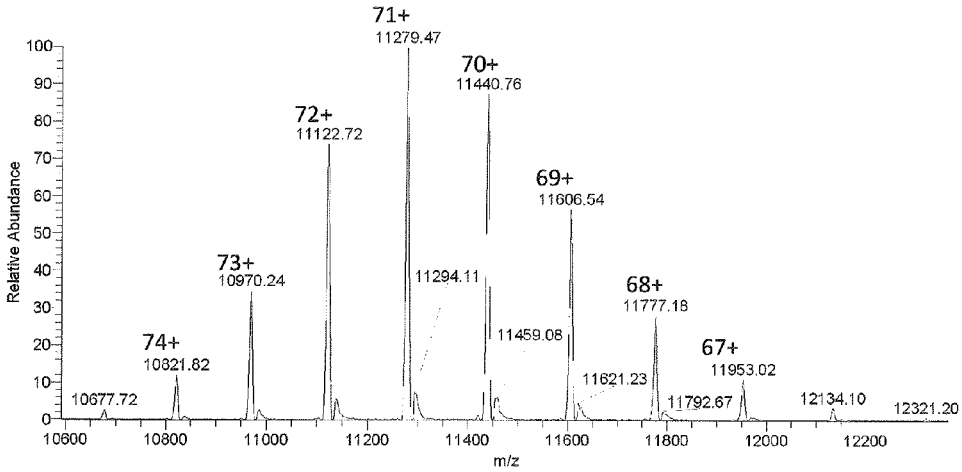
FIG. 3 shows a close-up of FIG. 2*d*.

In a further experiment a series of non-covalent protein assemblies of increasing molecular weight were analysed. FIG. 2*b-d* shows an overview of the mass spectra obtained for (b) pentameric and hexameric capsomer intermediates of the HK97 viral assembly (210 kDa and 253 kDa), (c) the yeast 20S proteasome (730 kDa) and (d) the chaperone protein GroEL (801 kDa). FIG. 3 shows a zoomed portion of the spectra for (d) For each assembly shown in FIG. 2*b-d*, a narrow charge state distribution is observed, indicative of the native structure of the complexes being retained. For example, the largest protein complex measured here. GroEL, populates charge states 68+ to 77+ at m/z 10,000 to 12,000. The FVVHM resolution of these peaks is over 2000, and the experimental molecular weight is 800,782.2±23.6 Da (mass accuracy of 20 ppm compared to the theoretical molecular weight 800,766.4 Da). The observed peak width is significantly narrower than observed in equivalent experiments on Q-T of instrumentation.

Figure 4:
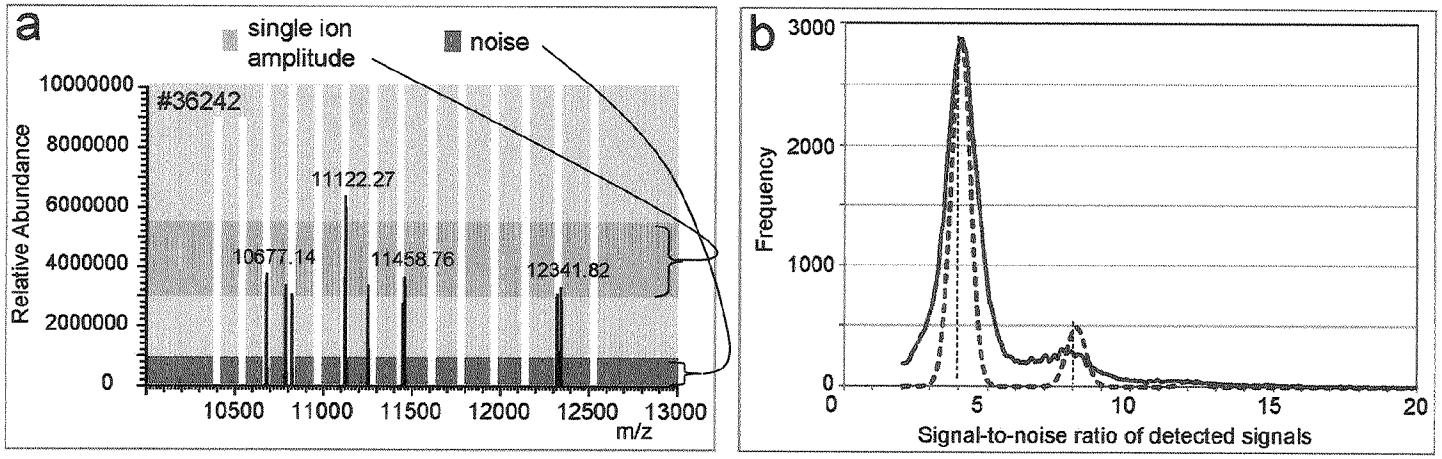
FIG. 4*a* shows a single scan mass spectrum of individual ions of GroEL to demonstrate sensitivity.
FIG. 4*b* shows the distribution of detected signals over signal-to-noise ratios (S/N) for the three most intense charge states of GroEL indicating the quantised nature of the S/N ratios.

To demonstrate the sensitivity of the present invention, individual ions of GroEL were detected in single scans (FIG. 4*a*). Quantised signal changes in steps of 1, 2, etc., were detected with the first maximum in the S/N distribution of FIG. 4*b* corresponding to the detection of one individual ion of a particular charge state, and the second maximum to detection of two ions appearing simultaneously at the same m/z. When successive scans were summed together, they accurately reproduced the spectrum acquired for multiple ions of GroEL.

Figure 5:
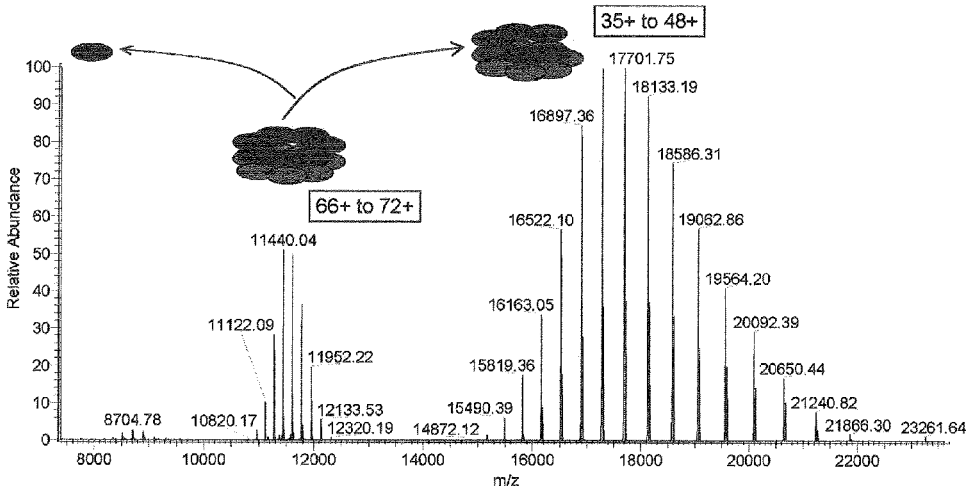
FIG. 5 shows a mass spectrum for high-energy collision induced dissociation (HCD) performed on GroEL.

In further experiments, the invention was also used for: (i) tandem MS allowing analysis of individual subunits dissociated from a complex and (ii) analysis of small mass changes on high molecular weight species, which could be indicative of the binding of small molecules, drugs, ligands, nucleotides, lipids etc. For (i), higher-energy collision induced dissociation (HCD) was performed on GroEL. This resulted in asymmetric expulsion of a monomer to leave a 13-subunit complex with a relatively low number of charges. Peaks for this dissociation product were observed in the m/z range 15,000-22,000 as shown in FIG. 5.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method for mass analysing multiply-charged ions comprising:

trapping the multiply-charged ions in a gas-filled ion trapping device;

collisionally cooling the multiply-charged ions in said gas-filled ion trapping device;

introducing the collisionally cooled, multiply-charged ions from said gas-filled ion trapping device into an electrostatic mass analyser where ions undergo multiple changes of direction of motion;

detecting the ions in the analyser; and determining the mass-to-charge ratio of at least some of the detected ions;

wherein the absolute velocity in the analyser of at least some of the ions whose mass-to-charge ratio is determined is not greater than 8,000 m/s and the average path length over the duration of detection of said ions is longer than required for detecting said ions with a mass-to-charge ratio resolving power of 1,000.

2. A method according to claim 1, wherein detecting the ions in the mass analyser is by image current detection.

3. A method according to claim 1 further comprising filtering the ions through at least one filter, which comprises one or both of a mass-to-charge ratio filter and an energy filter, disposed upstream of the mass analyser.

4. A method according to claim 1 further comprising filtering the ions through a voltage barrier upstream of the mass analyser acting as a low mass-to-charge ratio or low energy filter.

5. A method according to claim 1 wherein an energy filter is applied to the ions following their expansion in a gas.

6. A method according to claim 5 wherein the expansion in a gas occurs at an atmosphere-to-vacuum interface.

7. A method according to claim 5 wherein the residual energy of the ions during the filtering is proportional to mass and is in the range 0.5 to 1 V/kTh, or greater.

8. A method according to claim 3 wherein ions of mass-to-charge ratio a) less than 3000, b) less than 4,000, or c) less than 5,000 are substantially filtered out and thereby prevented from entering the mass analyser.

9. A method according to claim 3 wherein trapping the ions is performed after passing the ions through the at least one filter.

10. A method according to claim 3 wherein collisionally cooling the ions is performed after passing the ions through the at least one filter.

11. A method according to claim 1 wherein the absolute velocity of the at least some of the ions in the mass analyser whilst detecting them is not greater than 6,000 m/s.

12. A method according to claim 11 wherein the absolute velocity of the at least some of the ions in the mass analyser whilst detecting them is not greater than 5,000 m/s.

13. A method according to claim 1 wherein at least some of the ions whose mass-to-charge ratio is determined and whose velocity is not greater than 8,000 m/s have m/z exceeding 5,000.

14. A method according to claim 13 wherein the ions have m/z exceeding 10,000.

15. A method according to claim 1 wherein the mass-to-charge ratio is determined from individual ions of an ion species in the mass analyser.

16. A method according to claim 1 wherein the ions comprise ions of proteins or protein complexes.

17. A method according to claim 1 wherein the ions are produced by electrospray, MALDI, laserspray or inlet ionization.

18. A method according to claim 17 wherein the ions are sprayed from a solution with a pH in the range 6 to 8.5.

19. A method according to claim 2 wherein detecting the ions in the analyser by image current detection comprises detecting an image current transient signal and the pressure in the mass analyser is kept below a level whereby the decay constant of the image current transient signal is at least a) 10 ms, or b) at least 20 ms, or c) at least 40 ms.

20. A method according to claim 2 comprising detecting an image current transient signal and transforming the image current transient signal into a mass spectrum wherein the mass spectrum can be used to resolve peaks originating from covalent and/or non-covalent binding of small molecules to proteins or protein assemblies.

21. A mass analyser comprising:

a gas-filled ion trap for trapping the ions and for collisionally cooling the ions;

an electrostatic mass analyser for receiving the collisionally cooled ions from the gas-filled ion trap, the electrostatic mass analyser comprising a detection system for detecting the ions in the electrostatic mass analyser;

a signal processing system for determining the mass-to-charge ratio of at least some detected ions; and a control system that is configured to control the introduction of ions into the electrostatic mass analyser such that the absolute velocity in the electrostatic mass analyser of at least some of the ions whose mass-to-charge ratio is determined is not greater than 8,000 m/s, and that is configured to control the average path length over the duration of detection of such said ions to be is longer than required for detecting said ions with a mass-to-charge ratio resolving power of 1,000.

22. A mass analyser according to claim 21 wherein the detection system is an image current detection system.

23. A mass analyser according to claim 21 further comprising at least one filter, comprising one or both of a mass-to-charge ratio filter and an energy filter, the at least one filter disposed upstream of the mass analyser.

24. A mass analyser according to claim 23 further comprising electrodes for applying thereto a barrier voltage to act as the mass-to-charge ratio or low energy filter.

25. A mass analyser according to claim 24 wherein said electrodes comprise rods of a multipole ion guide.

26. A mass analyser according to claim 23 wherein the at least one filter is positioned downstream of an atmosphere-to-vacuum interface.

27. A mass analyser according to claim 26 wherein the atmosphere-to-vacuum interface determines that the residual energy of the ions during the filtering is proportional to mass and is in the range 0.5 to 1 V/kTh, or greater.

28. A mass analyser according to claim 23 wherein the at least one filter is configured to substantially filter out ions having mass-to-charge ratio less than 3000 and thereby prevent such ions from entering the mass analyser.

29. A mass analyser according to claim 23 wherein the ion trap is disposed downstream of the at least one filter and upstream of the mass analyser.

30. A mass analyser according to claim 29 wherein the ion trap is a curved linear ion trap.

31. A mass analyser according to claim 23 further comprising a collision cell downstream of the at least one filter and upstream of the mass analyser.

32. A mass analyser according to claim 21 wherein the control system is configured to control the introduction of ions into the mass analyser so that the absolute velocity of at least some of the ions in the mass analyser during detection is not greater than 6,000 m/s.

33. A mass analyser according to claim 32 wherein the control system is configured to control the introduction of ions into the mass analyser so that the absolute velocity of at least some of the ions in the mass analyser during detection is not greater than 5,000 m/s.

34. A mass analyser according to claim 21 wherein the ions comprise ions of proteins or protein complexes.

35. A mass analyser according to claim 21 further comprising an ion source which is one of: an electrospray source, a MALDI source, a laserspray source, and an inlet ionization source.

36. A mass analyser according to claim 35 wherein the ion source produces ions from a solution with a pH in the range 6 to 8.5.

37. A mass analyser according to claim 21 wherein the detection system is for detecting an image current transient signal from the ions and the pressure in the mass analyser is kept below a level whereby the decay constant of the image current transient signal is at least a) 10 ms, or b) at least 20 ms, or c) at least 40 ms.

38. A mass analyser according to claim 21 wherein electrostatic mass analyser is an electrostatic ion trap.

39. A mass analyser according to claim 38 wherein the electrostatic ion trap is an orbital electrostatic ion trap.

40. A method for mass analysing multiply-charged ions comprising:

filtering the multiply-charged ions according to at least one of mass-to-charge ratio and energy;

collisionally cooling the filtered, multiply-charged ions using a gas;

introducing the filtered and collisionally cooled, multiply-charged ions into an electrostatic mass analyser where said ions undergo multiple changes of direction of motion;

detecting the ions in the analyser; and determining the mass-to-charge ratio of at least some of the detected ions;

wherein the absolute velocity in the analyser of at least some of the ions whose mass-to-charge ratio is determined is not greater than 8,000 m/s and the average path length over the duration of detection of said ions is longer than required for detecting said ions with a mass-to-charge ratio resolving power of 1,000.

41. A method according to claim 40 wherein at least some of the ions whose mass-to-charge ratio is determined and whose velocity is not greater than 8,000 m/s have m/z exceeding 5,000.

42. A method according to claim 41 wherein the ions have m/z exceeding 10,000.

43. A method according to claim 41, wherein detecting the ions in the mass analyser is by image current detection.

* * * * *